US005882243A

United States Patent [19]

Das et al.

[11] Patent Number: 5,882,243

[45] Date of Patent: Mar. 16, 1999

[54] METHOD FOR POLISHING A SEMICONDUCTOR WAFER USING DYNAMIC CONTROL

[75] Inventors: Sanjit Das; Subramoney Iyer; Olubunmi Adetutu; Rajeev Bajaj, all of Austin, Tex.

[73] Assignee: Motorola, Inc., Schaumburg, Ill.

[21] Appl. No.: 839,996

[22] Filed: Apr. 24, 1997

[51] Int. Cl.[6] ..... B24B 49/04; B24B 51/00

[52] U.S. Cl. ..... 451/5; 451/9; 451/10; 451/11; 451/41; 451/63; 451/288

[58] Field of Search ..... 451/5, 8, 9, 10, 451/11, 36, 41, 59, 62, 287, 288, 289, 290, 385, 388, 397, 398, 402; 340/680

[56] References Cited

U.S. PATENT DOCUMENTS

| | | | |
|---|---|---|---|
| 4,802,309 | 2/1989 | Heynacher | 451/5 X |
| 4,850,152 | 7/1989 | Heynacher et al. | 451/5 |
| 4,897,966 | 2/1990 | Takahashi | 451/287 |
| 4,918,869 | 4/1990 | Kitta | 451/288 |
| 5,486,129 | 1/1996 | Sandhu et al. | 451/5 |
| 5,651,724 | 7/1997 | Kimura et al. | 451/287 X |
| 5,700,180 | 12/1997 | Sandhu et al. | 451/5 |

*Primary Examiner*—Timothy V. Eley
*Attorney, Agent, or Firm*—Patricia S. Goddard; Jeffrey S. Abel

[57] ABSTRACT

A polishing system (10) is used to polish a semiconductor wafer (16) in accordance with the present invention. Polishing system (10) includes a wafer carrier (14) which includes a modulation unit (20). Modulation unit (20) includes a plurality of capacitors made up of a flexible lower plate (22) and a plurality of smaller upper plate segments (24). A controller (40) monitors the capacitance between each smaller upper plate segment (24) and lower plate (22), and compares the measured capacitance against a predefined set capacitance. To the extent the measured capacitance and predefined capacitance are different, controller (40) adjusts the voltage being applied to the respective upper plate segment (24) so that the measured capacitance and predefined capacitance are aligned. Thus, the present invention is able to achieve dynamic and localized control of the shape of the wafer as it is being polished.

10 Claims, 1 Drawing Sheet

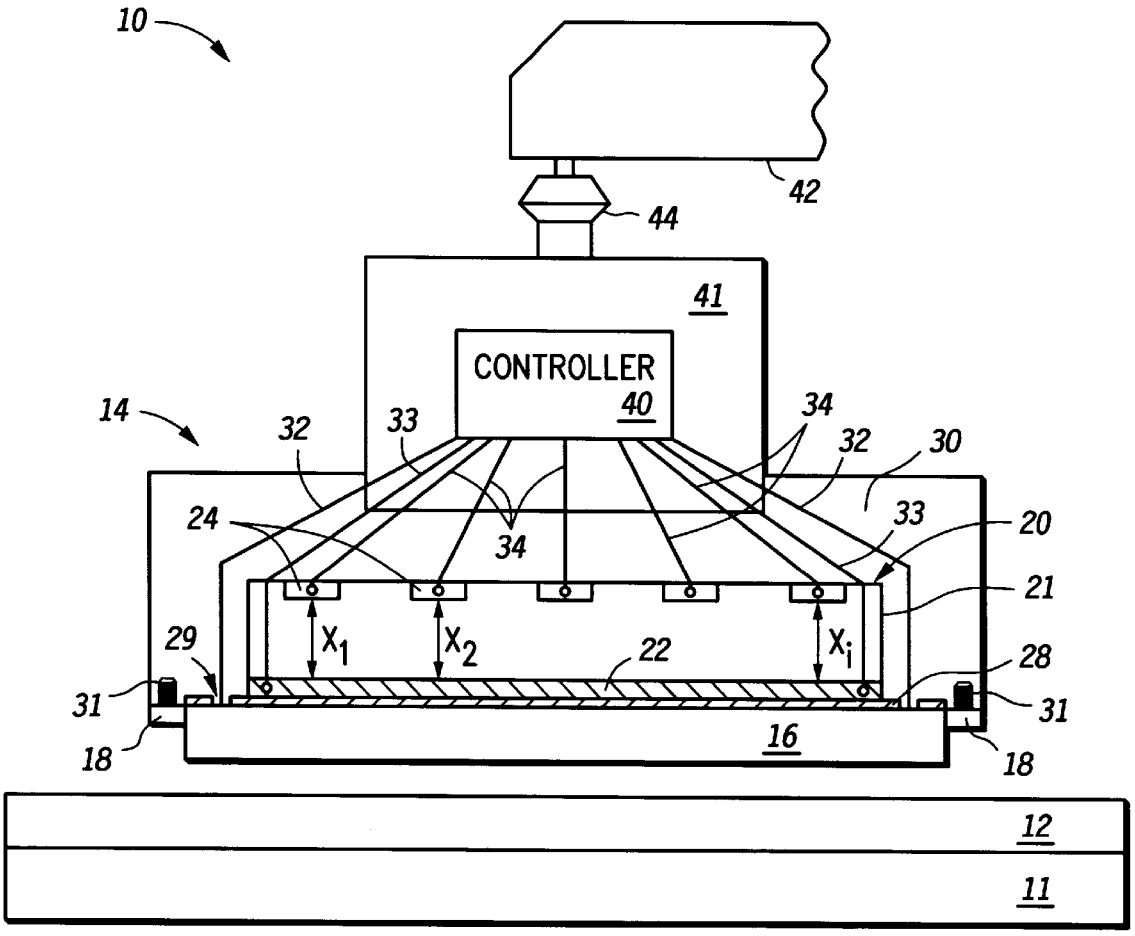
FIGURE

METHOD FOR POLISHING A SEMICONDUCTOR WAFER USING DYNAMIC CONTROL

FIELD OF THE INVENTION

The present invention relates generally to methods for manufacturing semiconductor devices, and more particularly, to methods for polishing semiconductor device wafers and an apparatus used in such processes.

BACKGROUND OF THE INVENTION

Chemical-mechanical polishing (CMP) is fast becoming an industry standard manufacturing process in semiconductor wafer fabrication. CMP is used to planarize various dielectric and conductive layers which are deposited on a wafer. Planarization is necessary to enable subsequent layers to be deposited and patterned without the underlying topography adversely affecting the patterning and deposition of these layers. In a typical CMP process, a wafer is held in a carrier and pressed against a rotating polishing pad in the presence of a slurry. A combination of the chemical and mechanical interaction between the semiconductor wafer, the slurry, and the polishing pad results in removal of the exposed films.

Despite the success of CMP, an ongoing problem with CMP is the ability to achieve uniform polishing across a wafer surface. The rate at which material is removed from the wafer varies radially from center to edge of the wafer. Typically, the center of the wafer polishes slower than the edges of the wafer. A fact which compounds this problem of polishing is that the wafer being polished is often not perfectly flat. For example, the wafer can be bowed to be either concave or convex, or can have more localized concavities or convexities. Factors which affect the shape of the wafer are the various thermal processes which the wafer has seen previously, and the types of films which are deposited onto the wafer.

Various solutions have been proposed to resolve the problems associated with non-uniform polishing. One proposed solution is to use a shaped carrier to hold the wafer during polishing. For example, the carrier is shaped to be concave or convex to match the shape of the wafer which is being polished. A problem with the use of the shaped carrier, however, is that the compensation is fixed. For example, a shaped carrier may work adequately for a convex wafer, but for a concave wafer the same carrier will actually degrade uniformity. Another solution to the problem is to shape the polishing platen rather than the wafer carrier. However, use of a shaped platen suffers from the same problem in that the shape of the platen is fixed while the shape of various wafers being polished will vary.

Yet another solution to the problem of polishing non-uniformity is the use of backside air. In using backside air, positive air pressure is applied to the backside of the wafer to cause the wafer to intentionally bow, thus increasing the contact area at the center of the wafer to the polishing pad. However, use of backside air likewise suffers from the fact that the amount of pressure being applied is constant regardless of whether the wafer being polished is concave, convex or flat.

Accordingly, there is a need in the semiconductor industry for a method for polishing semiconductor wafers which provides uniform polishing despite the incoming shape of the wafer being polished. Furthermore, it would be desirable for such a process to be easily integrated into existing manufacturing processes, and with minimal impact on manufacturing costs and wafer throughput.

BRIEF DESCRIPTION OF THE DRAWING

The sole FIGURE in the application is a cross-sectional view of a polishing system having a wafer carrier which dynamically modulates the shape of the wafer as it is polished in accordance with the present invention.

DETAILED DESCRIPTION OF A PREFERRED EMBODIMENT

Generally, the present invention provides a method for polishing semiconductor wafers while dynamically controlling the shape of the wafer during polishing. In one embodiment, a wafer carrier is designed to include a modulation unit which includes a plurality of capacitors. The plurality of capacitors are made up of several small plates which are attached to the top of the modulation unit housing and a large common plate which is attached to the back of the semiconductor wafer. The common plate is a flexible plate which conforms to the wafer shape. The distance from the smaller plates to the common plate is determined from the capacitance, and this distance can be modulated. A voltage is applied to the smaller plates to provide a predetermined distance between each small plate and the common plate of the capacitors. By having the ability to monitor and change the distance between each smaller plate and the common plate on the back of the wafer, the shape of the wafer during polishing can be tightly controlled regardless of the incoming shape of the wafer to the polishing operation. Furthermore, in practicing the present invention, as the wafer is polished and the inherent shape of the wafer changes, the modulation unit will dynamically compensate for this change to maintain a constant wafer shape during polishing. In one embodiment of the present invention, the modulation unit is incorporated into the wafer carrier. Thus, while the same carrier is used to polish a variety of different wafers, the modulation unit customizes the carrier to each wafer being polished to achieve an optimal wafer shape during polishing.

These and other features of the present invention will be better understood by the following detailed description taken in conjunction with the FIGURE. It is important to point out that the FIGURE is not necessarily drawn to scale, and that there are likely to be other embodiments of the present invention which are not specifically illustrated.

Illustrated in a cross-sectional view in the FIGURE is a polishing system 10 used for polishing semiconductor wafers in accordance with the present invention. Polishing system 10 includes a polishing platen 11 having a polishing pad 12 thereon and a wafer carrier 14. A semiconductor wafer 16 is held within carrier 14 by a retaining ring 18. Retaining ring 18 holds wafer 16 in the carrier as in conventional CMP wafer carriers. Wafer carrier 14 also includes a modulation unit 20 in accordance with the present invention. Modulation unit 20 includes a housing 21 which forms the sides and top of the unit, and a lower, flexible plate 22 which forms the bottom of the unit. Modulation unit 20 also includes a plurality of upper smaller plates 24, which together with flexible plate 22 form a plurality of capacitive elements within the modulation unit, with the flexible plate 22 being common to all capacitive elements. The upper and lower plates are separated by air. Modulation unit 20 is situated within the carrier such the flexible plate 22 conforms with the backside surface of semiconductor wafer 16 through a carrier film 28. Carrier film 28 serves as a mechanical buffer between the semiconductor wafer and the rigid elements of the wafer carrier and modulation unit. In accordance with the invention, carrier film 28 is the same as carrier films used in existing CMP carriers. An exception, perhaps, may be the location of holes 29 for the purposes of establishing a vacuum to pickup wafer 16, as discussed further below.

Wafer carrier 14 also includes a carrier housing 30 which surrounds modulation unit 20. Carrier housing 30 includes vacuum channels 32, electrical wiring channels 34 for making electrical connections to each of the upper smaller plates 24 of the capacitors, and electrical wiring channels 33 for making electrical connections to the common lower plate 22. Carrier housing can be made of stainless steel or other material which is compatible with the polishing process. Retaining ring 18 is also attached to carrier housing 30, e.g. by screws 31, to hold wafer 16 within the carrier.

Polishing system 10 also includes a controller 40 which is housed above carrier housing 30 in a controller housing 41 and provides control of the vacuum lines and the electrical connections to the capacitors of the modulation unit. Controller 40 and wafer carrier 14 are attached to a polishing arm 42 of the polishing system through a rotary union 44. Rotary union 44 enables the wafer carrier, controller, and everything contained therein to be rotated during polishing while polishing arm 42 remains stationary. Controller 40 may also be used to control rotation of the carrier.

As stated previously, modulation unit 20 of wafer carrier 14 includes a flexible lower plate 22 and a plurality of upper plate segments 24. In one embodiment, upper plate segments 24 are attached, but electrically isolated from, housing 21. In other embodiments, the upper plate segments can be located anywhere within the housing, provided that the upper plate segments are in a stationary location to serve as a reference for measuring the distance to the backside of the wafer surfaced and to form the desired capacitive effective with flexible lower plate 22. Housing 21 can be formed of a metal shell, such as stainless steel, or other material which is sufficient to provide mechanical support for the modulation unit. However, if formed of a conductive material, upper plate segments 24 and/or flexible plate 22 should be electrically isolated from the housing so that each can be electrically biased independently. In a preferred embodiment, housing 21 is formed to be rigid along the sidewalls and top of the modulation unit, while lower plate 22 remains flexible. Lower plate 22 is preferably made of a thin plate of conductive material, such as a sheet of stainless steel having a thickness of 1/32 of an inch or less. The thickness is only limited by the extent to which the plate conforms to the shape of the wafer. The thinner the plate, the better it will conform. The common lower plate can be attached to the rest of housing 21 by standard welding or another form of mechanical attachment.

As illustrated, a distance "$X_i$" exists between each of the upper segmented plates 24 and common lower plate 22. Thus, X can be viewed as a dielectric thickness between two plates (the flexible lower plate 22 and the upper plate segments 24) of a capacitor. Because lower plate 22 is flexible and because there are a plurality of upper plate segments 24, the distances X at different locations can be varied within the modulation unit. A flexible lower plate 22 is designed to conform to the shape of wafer 16 during polishing such that if the wafer is either concave or convex, the distances between the lower common plate and the upper smaller plate can be controlled to maintain a desired shape for the wafer.

In practicing the present invention, the plurality of capacitors within the modulation unit 20 are controlled to provide a predetermined spacing ($X_i$) at each of the capacitor locations within the modulation unit to achieve an optimal wafer shape during polishing. The manner in which the capacitors provide this predetermined spacing is by controlling the capacitance between each upper plate segment 24 and lower plate 22. The capacitance at each location is measured, and compared to a predefined capacitance for that location. If the measured capacitance differs from the predefined capacitance, the voltage being supplied to the small upper plate 24 corresponding to that location is increased or decreased accordingly. Increasing the voltage will tend to decrease the spacing, while decreasing the voltage will tend to increase the spacing. In determining the difference between the predefined capacitance and the actual measured capacitance, one may either look at the absolute capacitance at each location or may look at differential capacitances across all locations. Controller unit 40 is the mechanism which measures the capacitances, compares them to their predefined values, and adjusts voltages accordingly through a feedback loop. Controller 40 of polishing system 10 is operated through the main controller (not shown) of the polishing system, and can be programmed in the same manner as other processing parameters for the polisher.

It should be noted that while modulation unit 20 has been thus far described in reference to using a plurality of capacitors to maintain a predetermined distance between upper plates 24 and lower plate 22, there are other methods for establishing a controlled distance that are also suitable in practicing the present invention. For example, in place of capacitors as previously described, a plurality of inductors can be used in a similar manner. As compared to a capacitive method, an inductive method would employ a common lower coil and a plurality of upper smaller coils. In practice, the induced voltage between each of the smaller inductor coils and the lower inductor coil can be adjusted to control the spacing between these elements. In another technique, a plurality of pressure transducers can be used to maintain an optimal wafer shape during polishing. The pressure transducers can sense the pressure at a variety of locations across the wafer, while a plurality of actuators can individually change local pressure, by increasing or decreasing it, to achieve a desired pressure at any one location. In this method, rather than monitoring or maintaining a particular distance, pressure is being measured, but the pressure can be translated into a separation distance. In yet another embodiment, magnetic force can be used to achieve the desired wafer shape during polishing. In this embodiment, the wafer carrier is designed to include a magnet, for example, at the upper portion of modulation unit 20. As part of the flexible lower plate, a plurality of conductors are formed at right angles to the magnetic field generated within the carrier. Current is passed through these conductors to create an induced force which can be measured at a variety of locations across the wafer. The induced forces at the various locations are then compared to a reference force, and current through the conductors is changed accordingly to achieve a uniform force across all locations of the wafer.

To polish a semiconductor wafer in accordance with the present invention, wafer 16 is loaded into the carrier 14. The wafer is held within carrier 14 using vacuum pick-up until the retaining ring 18 is in place to hold the wafer. Vacuum can be applied to the backside of the wafer through vacuum channels 32. If a carrier film 28 will be separating the wafer from the carrier, holes 29 should be included in the carrier film to accommodate vacuum pick-up. Once the retaining ring is in place, carrier 14 is lowered by polishing arm 42 such that wafer 16 is in contact with the rotating polishing pad. A slurry is dispensed onto the pad during polishing, and is likely to be dispense before the wafer comes into contact with the pad. The slurry composition and pad material can be chosen in accordance with conventional practices depending upon which type of layer (for example, be it dielectric or conductive) is being polished from the wafer. During polishing, controller 40 is continuously monitoring the distances $X_i$ between each of the smaller upper plate segments 24 and flexible lower plate 22. As any of these distances vary out of a specification range, controller 40 adjusts the voltages accordingly, such that the distances are brought to within the desired specification.

From the foregoing it is apparent that the present invention has many advantages over prior art techniques for increasing polishing uniformity. In particular, it has been described that locations across the semiconductor wafer can be individually controlled to establish a predefined optimal shape of the wafer during polishing. Moreover, this shape can be maintained dynamically during the polishing operation, rather than in a one-time fixed method as is previously done by the prior art. The present invention is achievable with an addition of a modulation unit to a wafer carrier which is controlled by the main computer of the polishing system. Accordingly, no additional processing steps or consumables are necessary in practicing the present invention. By enabling dynamic control of the wafer shape during polishing, uniformity of the polishing process can be achieved regardless of the incoming shape of the wafer being polished. As the size of semiconductor wafers continues to grow, it is believed that the present invention will be necessary in order to achieve the precise control of pressure against the wafer backside during polishing to ensure successful and uniform planarization.

Thus, it is apparent that there has been provided a method for polishing a semiconductor wafer in accordance with the present invention that fully the needs and advantages set forth previously. Although the invention has been described in reference to a specific embodiment, it is important to note that the invention is not limited to this specific embodiment. Variations and modifications of the invention can be made without departing from the spirit of the invention. For example, rather than having a plurality of individual isolated upper plate segments 24, the upper capacitor plates can be configured as concentric rings, including having a center ring, a middle ring and an edge ring. Furthermore, lower flexible plate 22 need not be a solid conductive material, but can also be configured as rings or as individual segments to match the locations of the upper plate segments. In yet another embodiment, each modulation location can be made up of two capacitive elements having a common plate located between a top plate segment and a bottom plate segment and physically mounted to the carrier film. The capacitance between the middle common plate and the top plate segment is controlled to be equal to the capacitance between the middle common plate and the bottom plate segment. In this manner, the common plate can be moved in either direction depending upon whether voltage is applied to the top or bottom plate segment. While the words "plate" and "plane" have been used throughout this description, it is important to note that mechanisms which control the distance from a reference point to the wafer need not be planar nor in the form of a plate-like member. Furthermore, it is not necessary that the distances ($X_i$) at each capacitive location be equal across the wafer. For example, it may be desired that the distance at the center of the wafer be maintained to larger than at the edges of the wafer since the center tends to polish more slowly. Therefore, it is intended that the invention encompass all such variations and modifications following within the scope of the appended claims.

We claim:

1. A method for polishing a semiconductor wafer comprising the steps of:

providing a polishing apparatus having a wafer carrier, wherein the wafer carrier has a reference plane;

placing a semiconductor wafer within the wafer carrier;

defining a first predefined distance from the reference plane of the wafer carrier to a surface of the semiconductor wafer;

determining a first measured distance as a function of a difference between a first wafer location on the surface of the semiconductor wafer and the reference plane of the wafer carrier; and moving the first wafer location in response to the step of determining the first measured distance until the first measured distance is within a first predefined range around the first predefined distance.

2. The method of claim 1, wherein the step of providing the polishing apparatus comprises providing a polishing apparatus having a polishing pad, and further comprising the step of:

polishing the semiconductor wafer with the polishing pad, and wherein the steps of determining and moving are performed during the step of polishing.

3. The method of claim 1 further comprising the steps of:

defining a second predefined distance from the reference plane to the surface of the semiconductor wafer;

determining a second measured distance as a function of a difference between a second wafer location on the surface of the semiconductor wafer and the reference plane of the wafer carrier; and moving the second wafer location in response to the step of determining the second measured distance until the second measured distance is within a second predefined range around the second predefined distance.

4. The method of claim 3, wherein the step of defining the first predefined distance and the step of defining the second predefined distance comprise defining the first and the second predefined distances to a same value.

5. The method of claim 3, wherein the step of defining the first predefined distance and the step of defining the second predefined distance comprise defining the first and the second predefined distances to a different value.

6. The method of claim 5, wherein:

the step of determining a first measured distance comprises determining a first measured distance as a function of the difference between the first wafer location which is near a center of the semiconductor wafer and the reference plane;

the step of determining a second measured distance comprises determining a second measured distance as a function of the difference between the second wafer location which is near an edge of the semiconductor wafer and the reference plane; and the step of defining the second predefined distance comprises defining the second predefined distance as a value which is smaller than the first predefined distance.

7. A method for polishing a semiconductor wafer comprising the steps of:

providing a semiconductor wafer having a surface;

providing a polishing apparatus having a wafer carrier and a polishing pad, wherein the wafer carrier includes a flexible material and a reference plane;

mounting the semiconductor wafer into the wafer carrier such that the flexible material conforms to the surface of the semiconductor wafer;

polishing the semiconductor wafer by bringing the semiconductor wafer into contact with the polishing pad while the polishing pad is rotating and in presence of a polishing slurry;

monitoring a location of the flexible material relative to the reference plane during the step of polishing, by measuring a capacitance between the location of the flexible material and a conductive region of the reference plane; and moving the location of the flexible material if during the step of monitoring it is determined that the location of the flexible material is outside of an acceptable range.

8. The method of claim 7 wherein:

the reference plane includes a plurality of conductive regions associated with a plurality of locations of the flexible material;

the step of monitoring comprises monitoring the capacitance between the plurality of locations of the flexible material and the plurality of conductive regions of the reference plane; and the step of moving comprises moving only those locations of the plurality of locations of the flexible material which fall outside of respective acceptable ranges, independently of any locations of the plurality of locations of the flexible material which fall within respective acceptable ranges.

9. A method of polishing a semiconductor wafer comprising the steps of:

providing a polishing apparatus having a wafer carrier and polishing pad;

mounting the semiconductor wafer within the wafer carrier;

polishing the semiconductor wafer by bringing a surface of the semiconductor wafer in contact with the polishing pad in presence of slurry and while the polishing pad is being rotated; and dynamically controlling a shape of the semiconductor wafer as it is being polished by monitoring a plurality of pressure transducers corresponding to a plurality of locations of the semiconductor wafer, and locally controlling distances of the plurality of locations of the semiconductor wafer relative to a plurality of reference points within the wafer carrier by controlling the plurality of pressure transducers.

10. The method of claim 9 wherein the step of dynamically controlling comprises controlling the distances such that a first distance between a central location of the semiconductor wafer and a corresponding reference point of the wafer carrier is greater than a second distance between an edge location of the semiconductor wafer and a corresponding reference point.

* * * * *